United States Patent [19]

Bögner

[11] Patent Number: 4,755,781

[45] Date of Patent: Jul. 5, 1988

[54] ELECTRICAL SWITCH FOR STARTERS

[75] Inventor: Karl-Heinz Bögner, Neuhausen, Fed. Rep. of Germany

[73] Assignee: Robert Bosch GmbH, Stuttgart, Fed. Rep. of Germany

[21] Appl. No.: 63,129

[22] PCT Filed: Sep. 23, 1986

[86] PCT No.: PCT/DE86/00391

§ 371 Date: Jun. 4, 1987

§ 102(e) Date: Jun. 4, 1987

[87] PCT Pub. No.: WO87/02824

PCT Pub. Date: May 7, 1987

[30] Foreign Application Priority Data

Oct. 23, 1985 [DE] Fed. Rep. of Germany ..... 3537598

[51] Int. Cl.[4] ..... H01H 51/08

[52] U.S. Cl. ..... 335/131; 335/126; 335/255

[58] Field of Search ..... 335/131, 126, 255

[56] References Cited

U.S. PATENT DOCUMENTS

| | | | |
|---|---|---|---|
| 4,450,423 | 5/1984 | Morishita | 335/131 |
| 4,521,758 | 6/1985 | Krubsack | 335/131 |
| 4,637,267 | 1/1987 | Mazzorana | 335/131 |

*Primary Examiner*—H. Broome

*Attorney, Agent, or Firm*—Michael J. Striker

[57] ABSTRACT

An electromagnetic switch for starting mechanisms of internal combustion engines whose switching pin (22), which carries the contact bridge (29) for the main current contacts (13 and 14), is provided with a guide sleeve (25) with which the switching pin (22) is supported and guided in a magneto armature (15) and in a magnetic core (2). The switching pin (22) is supported at springs (21 and 36) and, accordingly, at the magneto armature (15) and the magnet core (2) by means of the guide sleeve (25). An armature return spring (21) supported at the magneto armature (15) contacts the guide sleeve (25). A stronger pressure spring (36) supported at the magnet core (2) contacts the guide sleeve (25). The magneto armature (15) and the switching pin (22), together with the guide sleeve (25), can move relative to one another. Accordingly, the spacing between the contact bridge (29) and the main current contacts (13 and 14) can be kept substantially smaller than the pulling-in distance of the magneto armature (15) to the magnet core (2). The pressure spring (36) disengages the contact bridge (29) from the main current contacts in a reliable manner after the switch is switched off, returns the switching pin (22) to its rest position and moves the magneto armature (15) away from the magnetic core (2), after which the armature return spring (21) continues to move the magneto armature (15) into its initial position.

13 Claims, 1 Drawing Sheet

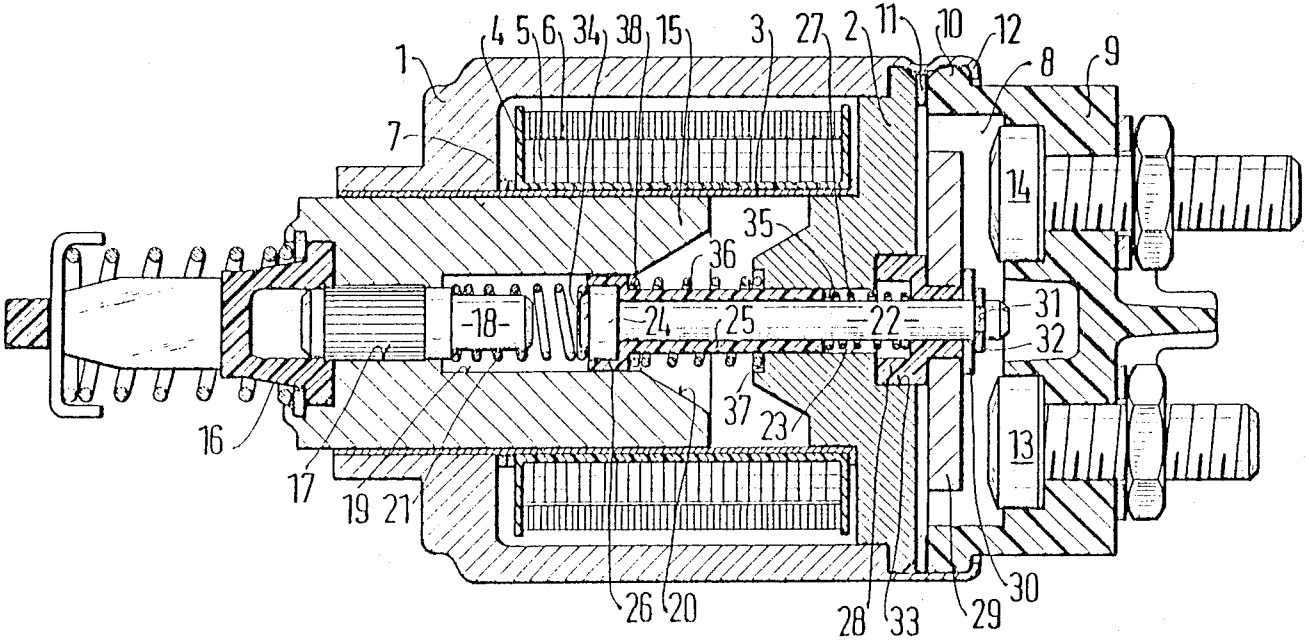
1
2
3
4
5
6
7
8
9
10
11
12
13
14
15
16
17
18
19
20
21
22
23
24
25
26
27
28
29
30
31
32
33
34
35
36
37
38

ELECTRICAL SWITCH FOR STARTERS

BACKGROUND OF THE INVENTION

The invention is based on an electromagnetic switch. In prior art switches, the switching pin is held by the armature return spring so as to be pressed against the magneto armature, so that the magneto armature and the switching pin can only be moved together and cannot execute relative movements with respect to one another. It is disadvantageous that the switching pin must travel the same distance as the magneto armature until a contact bridge lies at main current contacts and a magneto armature lies at a magnetic core. The long switching distance of a switching pin with the contact bridge requires a relatively large switching space. Such a switch is no longer usable because of the constantly diminishing installation space available in a motor vehicle. Moreover, an electromagnetic switch is known in which the magneto armature can move relative to the switching pin. The switching space can be made smaller, but the armature return spring, which is supported at the magneto armature and acts directly on the magneto armature, cannot influence the return movement of the contact bridge away from the main current contacts. Accordingly, the armature return spring can also not support the force of the return spring, which is accommodated in the switching space, in order to ensure the secure disengagement of the contact bridge from the main current contacts.

SUMMARY OF THE INVENTION

The invention has the object of providing an electromagnetic switch, in which a secure disengagement of the contact bridge from the main current contacts is made possible.

It is an advantage over the known electromagnetic switches that a switching path for a switching pin and a contact bridge can be kept small and a switching space can accordingly be kept flat. The contact bridge can be securely disengaged from the main current contacts by means of a pressure spring supported at a magnetic core and a welding to the main current contacts is accordingly prevented.

It is particularly advantageous to guide the switching pin through the guide sleeve in the magnet core as well as in the magneto armature. The guide sleeve consists, for example, of glass-fiber reinforced thermoplastic. This is done in order to counteract the effect of unwanted shaking and vibrating influences which occur in motor vehicles particularly during heavy-duty operation and, accordingly, in order to prevent damage to the magneto armature and magnetic core, as well as to the switching pin. Moreover, the pressure spring, which rests against the magnetic core, can be constructed so as to be strong enough to securely disengage the contact bridge from the main current contacts independently of the armature return spring.

BRIEF DESCRIPTION OF THE DRAWING

An embodiment example of the invention is shown in the drawing. It shows an electromagnetic switch in longitudinal cross-section.

DESCRIPTION OF THE PREFERRED EMBODIMENT

An electromagnetic switch has a cup-shaped housing 1 which simultaneously serves as a short-circuit yoke. A magnetic core 2 rests against its front side. One end of a brass sleeve 3, whose other end is inserted in a borehole in the base of the housing 1, rests on a shoulder of the magnetic core 2. A winding carrier 4 is arranged on the brass sleeve 3 and accommodates an exciter winding which is formed from a pull winding 5 and a hold-in winding 6. A spring 7, which holds the winding carrier 4 in the housing 1 so as to compensate for tolerances and so as to be resistant to shaking, is inserted between the base of the housing 1 and the winding carrier 4.

The outer front side of the magnetic core 2 defines a switching space 8 which is enclosed by a cap 9. The cap 9 has a flange 10 on its edge facing the magnetic core 2. A spring element 11 is inserted between the magnetic core 2 and the cap edge. A fastening edge 12 of the housing 1 extends over the magnetic core 2 and the flange 10 and is flanged behind the flange 10. Two main current contacts 13 and 14, which project into the switching space 8 and comprise connection pins leading out of the cap 9, are fastened in the cap 9. The connection pins are connected to the positive pole of a battery or to the field winding of a starting motor in a manner which is known per se and which is not explained in more detail.

A magneto armature 15 is guided into the brass sleeve 3 so as to be resistant to shaking. A carrier 16 for an engaging lever of a meshing gear unit, which engaging lever is not shown in more detail, is fastened at its end, which projects out of the brass sleeve 3 and, accordingly, out of the housing 1. The magneto armature 15 has an elongated borehole 17 in which is fastened an actuating pin 18 consisting of magnetizable working material. The actuating pin 18 projects into a widened portion 19 of the elongated borehole 17, an end portion 20, which widens in a funnelshaped manner, being connected to this widened portion 19. A pressure spring, which serves as an armature return spring 21, fits in the borehole portion 19. Its end coils are widened so that the end of the spring is fastened in the magneto armature 15. The end coils of the armature return spring 21, or the armature return spring 21 in its entirety, can also have a smaller diameter so that the end of the spring can be fastened on the actuating pin 18.

A switching pin 22, which consists of nonmagnetic work material, projects through a borehole 23 of the magnet core 2. It has a collar 24 at its end portion, which latter faces the actuating pin 18. A guide sleeve 25, which consists of damping and insulating material, for example, glass-fiber reinforced thermoplastic, is arranged on the collar 24 and a middle portion of the switching pin 22 which adjoins the latter. The guide sleeve 25 serves as a guide and support for the switching pin 22. In the area of the collar 24, the switching pin 22 is guided in the portion 19 of the borehole 17 and, accordingly, in the magneto armature 15 by means of an expanded end portion 26 of the guide sleeve 25. In its middle portion, the switching pin 22, which is still enclosed in the latter by the guide sleeve 25, is supported and guided in the borehole 23 of the magnet core 2. The guide sleeve 25, which consists of work material which damps the shaking influences, prevents the switching pin 22 from striking the borehole portion 19 of the magneto armature 15, which can lead to damage to the magneto armature 15, especially since the switching pin 22 consists of non-magnetizable material which is harder than the magneto armature 15.

By means of using the guide sleeve 25, cheaper and softer work material, for example, brass, can be used for the switching pin 22.

The switching pin 22 projects into the switching space 8 with its end portion. A contact pressure spring 27, a contact bridge carrier 28, which consists of insulating material and carries a contact bridge 29, a plate 30 and a stop ring 32, which fits in an annular groove 31, are arranged on the end portion. In the rest position of the switch, the contact bridge carrier 28 fits in a widened end portion 33 of the borehole 23 of the magnet core 2.

The armature return spring 21 rests against the front side 34 of the switching pin 22 with its end. The contact pressure spring 27, which is supported at the contact bridge carrier 28 by one end, rests against the front side 35 of the guide sleeve 25 with its other end. A pressure spring 36 surrounds the guide sleeve 25 in such a way that it is supported by one end in an annular recess 37 at the front side of the magnetic core 2, which front side faces the magneto armature 15, and contacts a collar 38 with its other end, which collar 38 is formed at the transition of the guide sleeve 25 to its widened end portion 26. Accordingly, the pressure spring 36 is supported at the collar 24 of the switching pin 25 by means of the guide sleeve 25. The pressure spring 36 is provided with a greater pressure force than the armature return spring 21.

The spring arrangement 21, 36 holds the structural component group consisting of switching pin 22, 24, 34, together with guide sleeve 25, 26, 35, 38, contact pressure spring 27, contact bridge carrier 28, with contact bridge 29 and the magneto armature 15 with actuating pin 18, in the rest position shown in the drawing by means of the pretensioning of the armature return spring 21.

When the winding 5, 6 is excited, the magneto armature 15 is drawn against the force of the armature return spring 21, which latter is further tensioned, toward the magnetic core 2 for the purpose of the meshing of the starting pinion, not shown, of the aforementioned meshing gear unit by means of the engaging lever, also not shown, which is articulated at the carrier 16 of the magneto armature 15. In so doing, the magneto armature 15, together with the actuating pin 18, is moved toward the magnetic core 2 and the switching pin 22. When the actuating pin 18 contacts the front side of the switching pin 22, the switching pin 22 is pushed further into the switching space 8 while the pulling-in movement of the magneto armature 15 continues, wherein the pressure spring 36 is also tensioned. During the movement of the switching pin 22 into the switching space 8, the contact bridge 29 is pressed against the main current contacts 13 and 14 and is held at the main current contacts 13 and 14 with the support of the contact pressure spring 27. The starting motor, not shown, which is connected to the connection pin of the main current contact 13, is accordingly connected with the current source in a manner known per se, the current source, also not shown, being connected to the connection pin of the main current contact 14. The starting motor receives current for starting the internal combustion engine.

When the internal combustion engine is started, the current supply to the exciter winding of the electromagnetic switch is turned off. The pressure spring 36, which is provided with substantially greater spring force than the armature return spring 21, then immediately separates the contact bridge 29 from the main current contacts 13 and 14. The switching pin 22, together with the guide sleeve 25, contact bridge carrier 28 and contact bridge 29, is moved back into the rest position shown in the drawing by the strong pressure spring 36 and disengages the magneto armature 15 from the magnetic core 2. The armature return spring 21 then moves the magneto armature 15 back again into its initial position.

I claim:

1. Electromagnetic switch for starting mechanisms of internal combustion engines, comprising a housing with a front side; a winding carrier accommodated in said housing, said winding carrier having an exciter winding and a sleeve; a magneto armature guided in said sleeve, said magneto armature having an actuating pin and an armature return spring; a magnetic core arranged at said front side of said housing; a switching pin having a front side and a collar, said switching pin being displaceably guided in said housing; a contact pressure spring; a contact bridge carrier supporting said contact pressure spring, said contact bridge carrier, together with a contact bridge, being movable on said switching pin, said switching pin, together with said contact bridge carrier and said contact bridge, projecting into a switching space; a cap covering said switching space; two main current contacts projecting into said switching space and arranged in said cap; a guide sleeve (25) fitting on said switching pin (22) and having a front side, said armature return spring (21) contacting said front side (34) of said switching pin (22), said contact pressure spring (27) contacting a front side (35) of said guide sleeve (25), said guide sleeve (25) having a stop 38; and means for pressing said stop (38) against said collar (24) of said switching pin (22) and including a pressure spring (36) supported at said magnet core (2).

2. Switch according to claim 1, characterized in that said guide sleeve (25), which fits on said switching pin (22), is guided in said magneto armature (15, 19) and in said magnet core (2, 23).

3. Switch according to claim 1, characterized in that said guide sleeve (25) consists of a damping, wear-resistant plastics material.

4. Switch according to claim 1, characterized in that said pressure spring (36) is provided with a spring force which is greater than said armature return spring (21).

5. Switch according to claim 2, characterized in that said guide sleeve (25) consists of a damping, wear-resistant plastics material.

6. Switch according to claim 1, wherein said first-mentioned sleeve is composed of brass.

7. An electromagnetic switch for starting mechanisms of internal combustion engines, comprising:

an excitable electrical winding;

a main current contact;

a contact bridge;

means for moving said contact bridge into electrical contact with said main current contact in response to said electrical winding becoming excited; and means for immediately separating said contact bridge from said main contact in response to said electrical winding no longer being excited and including a pressure spring biasing said contact bridge away from said main current contact, said moving means including a magneto armature and magnetic core, said magneto armature moving into contact with said magnetic core when said electrical winding is excited, said pressure spring further separating said magneto armature from said magnetic core when said electrical winding is no longer excited, said moving means further including an actuating pin and a switching pin, said actuating pin being fastened to said magneto armature, said switching pin projecting from said magnetic core, said contact bridge being movable in association with said switching pin, said actuating pin moving in association with said magneto armature into contact with said switching pin and thereafter press against said switching pin so as to move said switching pin and thereby move said contact bridge into contact with said main contact.

8. The switch according to claim 7, further comprising:

means for returning said magneto armature back into an initial position before said electrical winding becomes excited and including an armature return spring biasing said magneto armature back into said initial position after said pressure spring has separated said magneto armature from said magnetic core, said armature return spring being formed to compress under pressure when said magneto armature presses against said armature return spring in response to said electrical winding becoming excited.

9. The switch according to claim 7, wherein said switching pin is composed of non-magnetizable material harder than said magneto armature, said magneto armature being composed of magnetizable material; further comprising:

guide means for damping shaking influences and for preventing said switching pin from damaging said magneto armature and said magnetic core, said switching pin extending between said magneto armature and said magnetic core, said guide means including a guide sleeve between said switching pin and said magneto armature and between said switching pin and said magnetic core.

10. The switch according to claim 9, wherein said guide sleeve is fitted on said switching pin so as to be movable in association therewith.

11. The switch according to claim 9, wherein said guide sleeve is composed of a damping and insulating material.

12. The switch according to claim 10, wherein said damping and insulating material of said guide sleeve is a glass-fiber reinforced thermoplastic.

13. The switch according to claim 7, wherein said switching pin has a head portion and a remaining portion, said head portion being wider than said remaining portion, said pressure spring being arranged between said head portion and said magnetic core and around said remaining portion so as to bias said head portion away from said magnetic core.

* * * * *